United States Patent [19]

Dingwall et al.

[11] 4,009,432

[45] Feb. 22, 1977

[54] CONSTANT CURRENT SUPPLY

[75] Inventors: Andrew Gordon Francis Dingwall, Somerset; Bruce David Rosenthal, Randolph, both of N.J.

[73] Assignee: RCA Corporation, New York, N.Y.

[22] Filed: Sept. 4, 1975

[21] Appl. No.: 610,181

[52] U.S. Cl. ..... 323/4

[51] Int. Cl.² ..... G05F 1/56

[58] Field of Search ..... 307/296, 297, 304; 323/1, 4, 16, 19, 22 R

[56] References Cited

UNITED STATES PATENTS

| | | | |
|---|---|---|---|
| 3,508,084 | 4/1970 | Warner | 323/22 R |
| 3,777,251 | 12/1973 | Cecil et al. | 323/4 |
| 3,925,718 | 12/1975 | Wittlinger | 323/4 |

OTHER PUBLICATIONS

Allen, "Two-Terminal Constant-Current Device," EEE, Oct. 1965, vol. 13, No. 10, pp. 71, 72.

*Primary Examiner*—A. D. Pellinen
*Attorney, Agent, or Firm*—H. Christoffersen; S. Cohen; K. Watov

[57] ABSTRACT

A first field-effect transistorized constant current supply provides a first relatively constant output current. A second field-effect transistorized constant current supply is cascaded with, and driven by, the first current to provide a more highly regulated second constant output current. The system is self-starting and latch free. The second output current may be employed to drive a current mirror with a plurality of output current paths.

17 Claims, 4 Drawing Figures

CONSTANT CURRENT SUPPLY

This invention relates to constant current supplies.

In various embodiments of the invention, a first regulated current is employed to develop an output constant current which is regulated to a higher degree than the first regulated current.

IN THE DRAWINGS, where the like items are indicated by similar reference numbers:

In the various circuits to be discussed below, the transistors illustrated, for example, are N and P channel enhancement type field effect transistors of the metal oxide semiconductor (MOS) type. They are sometimes referred to hereafter as P or N type FET's.

Figure 1:
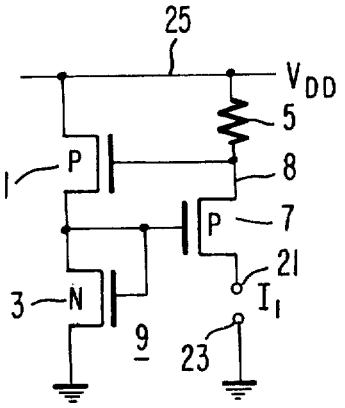
FIG. 1 is a schematic diagram of a constant current supply circuit.

In FIG. 1, FET's 1 and 3, of P and N type conductivities, respectfully, comprise an inverting amplifier which senses the voltage drop across the resistor 5. Assuming transistor 7 to be on initially and some current $I_1$ to be flowing through its conduction path (a load, not shown, being connected between output terminals 21 and 23), when $I_1$ is of a value such that the voltage across resistor 5 exceeds the threshold voltage of P type FET 1, that transistor 1 turns on, activating the amplifier. The voltage at the gate electrode of transistor 7 now increases and the voltage at its source electrode 8 follows this increase, thereby reducing the voltage drop across resistor 5. This voltage drop stabilizes within a short period of time to a value slightly greater than one P-threshold. As a result, a constant output current $I_1$ is established having the magnitude:

$$I_1 \approx V_{TP}/R_s \qquad 1.$$

where $V_{TP}$ = one P-threshold $R_s$ = value of resistor 5.

The "power supply rejection (P.S.R.)" is a measure of the capability of a constant current supply to reject variations of the supply voltage $V_{DD}$. High frequency ripple is normally filtered with a low pass filter. The P.S.R. times the ripple component or variation in $V_{DD}$ is a measure of the change that will be reflected in the output circuit of the supply. It can be shown that the P.S.R. is essentially a measure of the change in the output current for a change in the supply voltage $V_{DD}$. P.S.R. for the constant current supply 9 is as indicated in equation (2):

$$P.S.R. = \frac{\text{Power Supply Gain}}{\text{Amplifier Gain}} \qquad (2)$$

$$\text{where Power Supply Gain} \approx \frac{\Delta I_1 R_s}{\Delta V_{DD}}$$

A = gain of the amplifier including transistors 1 and 3, as given in equation (3):

$$A \approx \sqrt{\frac{K_P}{K_N}} \qquad (3)$$

where $K = \mu\epsilon/2t_{ox}$ $\mu$ = carrier mobility $\epsilon$ = dielectric constant of the material $2t_{ox}$ = twice thickness of the insulation (oxide) of the channel $$N = \frac{\text{Channel Width}}{\text{Channel Length}}$$

In order for the circuit to regulate, the supply voltage $V_{DD}$ should be greater than one N-threshold plus two P-thresholds.

In theory, a high gain A can be achieved, but in practice, gains of greater than 20 cannot be attained in monolithic COS/MOS circuits of the type shown in FIG. 1, because the large transistor geometries required are not practical. Accordingly, in integrated circuit applications, the current supply 9 exhibits a poor power supply rejection, and a low output impedance, due to the low value of gain A available. As a result, although the constant current supply 9 is latchup free (it does not lose regulation in normal operation), it does not provide a highly regulated output current $I_1$.

Figure 2:
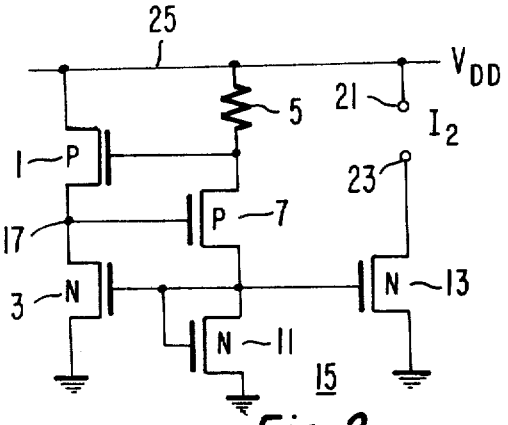
FIG. 2 is a schematic diagram of the constant current supply of FIG. 1 modified to include an internal "mirror circuit"

In FIG. 2, the constant current supply 9 is modified to include two additional N-type FET's 11 and 13, in an attempt to provide a higher performance constant current supply 15. In this modified supply 15, the constant current flowing through transistor 11 is "mirrored" to operate the constant current "amplifier lead" transistor 3, and the "output lead" transistor 13. This modified supply 15 has limited but improved gain over current supply 9.

A disadvantage of the modified supply 15 is that it is substantially not self-starting. Also, the supply 15 can "latch-up, " if the common connection or node 17 between transistors 1 and 3 attains a voltage level sufficient to cutoff transistor 7. When such latching occurs, the circuit loses control of the output current $I_2$.

Figure 3:
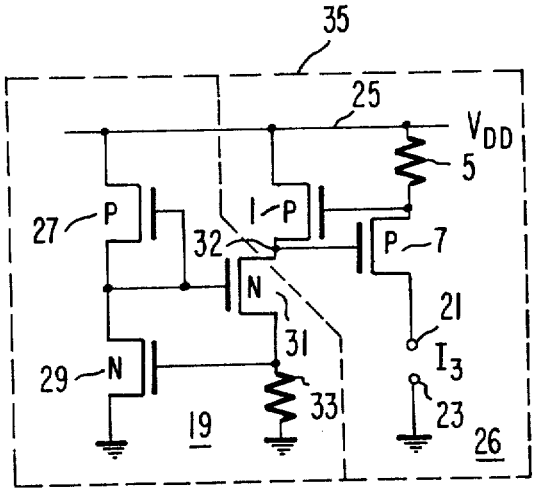
FIG. 3 is a schematic diagram of an improved current supply according to an embodiment of the invention.

The improved circuit of FIG. 3, includes a portion 26 of the supply of FIG. 1 and a secondary "stable" constant current supply 19 which replaces transistor 3. Supply 19 includes P-type FET 27 having a source electrode connected to a $V_{DD}$ voltage supply rail 25, and drain and gate electrodes connected to one another and to the drain and gate electrodes of N-type FET's 29 and 31, respectively. The FET 29 also has a source electrode connected to a point of reference potential (ground in this example), and a gate electrode coupled via a resistor 33 to ground. FET 31 has a source electrode coupled by resistor 33 to ground, and a drain electrode connected to the drain and gate electrodes of the P-type FET's 1 and 7, respectively, of primary current supply 26. Transistors 1 and 7 of supply 26 are interconnected in the same way as in FIG. 1.

In operation, constant current supply 35 is primed to start even without a load connected between output terminals 21 and 23. In the primed condition, the gate of FET 1 is high or substantially at $V_{DD}$, holding this FET cutoff. The gate of FET 31 is high or within a P-threshold of $V_{DD}$, priming FET 31 "on." This places the gate of FET 7 at ground potential priming FET 7 to the on condition. FET 29 is off as its gate is at ground potential.

If a load is now connected between output terminals 21 and 23, FET 7 will conduct current through its source-drain electrode current path, causing a voltage drop to develop across resistor 5. As the voltage drop across this resistor 5 increases, the voltage at the gate of FET 1 decreases, tending to turn 1 "on." When FET 1 turns on, the common node 32 between FET's 1 and 31 goes high, increasing in voltage toward $V_{DD}$, reducing the conduction of FET 7. Also, the current conducted by FET 31 is supplied to resistor 33, causing a voltage drop across resistor 33, in turn causing the voltage at the gate of transistor 29 to increase. FET 29 turns on, reducing the voltage at the gate of and the conduction through FET 31, tending to further reduce the conduction of FET 7, due to the cascade or feedback effect therebetween. Current source 35 will stabilize with voltages of about one P-threshold $(V_{TP})$ across resistor 5, and one N-threshold $V_{TN}$ across resistor 33. Thus, $I_3 \approx V_{TP}/R_5$.

In effect, stabilization is accomplished by a double feedback arrangement. The first feedback path includes the voltage feedback to the gate of transistor 7 for regulating the current through resistor 5 to the stable value such that $V_{TP}$ appears between gate and source electrodes of transistor 1. The second feedback path includes the voltage feedback from the current path 27, 29 to the gate of transistor 31 for regulating the current through resistor 33 (and therefore through the conduction path of transistor 1) to a stable value such that $V_{TN}$ appears across resistor 33.

FET 27 can be replaced by another constant current source, such as, for example, that of FIG. 1 or FIG. 3. Such further cascading will improve the gain of the constant current supply by a multiple of the gain of the stage added. The increased gain will improve the P.S.R. of the current source, that is it will reduce its value and yield a more constant output current for variations in the supply voltage $V_{DD}$.

The gain A for this unique constant current supply 35 is:

$$A = g_m R_L \quad 4$$

where $g_m$ is the transconductance of FET 1, and $R_L$ is the saturation resistance of FET 1.

Gains as defined above of higher than 500 are attainable with the configuration of constant current supply 35. This current supply 35 is self-starting, as both the primary 26 and secondary 19 stages are self-starting. In addition, latch-up does not occur in these stages 26, 19, for the various gate voltages are maintained at levels preventing cutoff of the FET's of either stage 26, 19.

Figure 4:
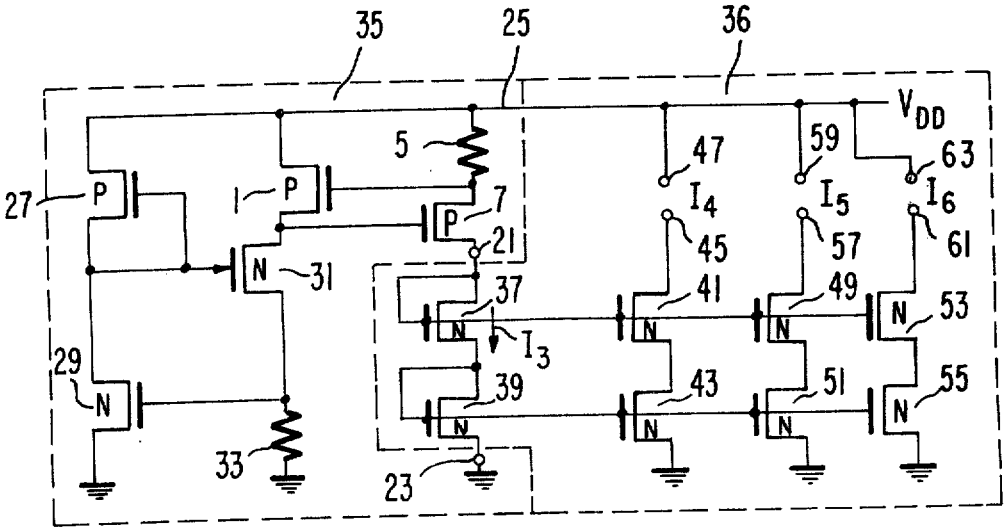
FIG. 4 is a schematic diagram of another embodiment of the invention.

In FIG. 4, the constant current supply 35 is used as a master current supply to control a plurality of other constant current supplies 36. A pair of diode connected N-type FET's 37 and 39 are connected in series between output terminals 21 and 23. FET 37 has gate and drain electrodes connected to output terminal 21. FET 39 is connected at its gate and drain electrodes to the source electrode of FET 37 and at its source electrode to ground. Another pair of N-type FET's 41 and 43 are connected in cascode between one output terminal 45 and ground. The other output terminal 47, is connected to the voltage supply rail 25. FET 41 is connected at its gate electrode to the gate of FET 37; FET 43 is connected at its gate electrode to the gate electrode of FET 39. The output circuits for $I_5$ and $I_6$ are similar to the one just described for $I_4$.

In operation, the supply 35 operates in the manner already discussed with the current $I_3$ flowing through the cascode connected FET's 37 and 39. These two FET's serve as the input circuit of a current mirror with the branches producing the output currents $I_4$, $I_5$, and $I_6$ serving as the output circuits of the mirror. In other words, the constant current $I_3$ flowing between the output terminals 21 and 23 of current supply 35 is "mirrored" at the pairs of cascoded transistors 41, 43; 49, 51; and 53, 55; to provide individual constant output currents $I_4$ and $I_5$, and $I_6$, respectively. The values of these currents with respect to the input current $I_3$ will depend on the relative channel dimensions of the input FET's (37, 39) to the output FET's (41, 43, for $I_4$; 49, 51 for $I_5$; and so on). Any number M of transistors such as 37, 39 can be cascoded to provide the input circuit for mirror 36. Further, any of the output circuits then can have M or fewer than M cascoded FET's, each connected at its gate electrode to the gate-drain connection of a different one of the input transistors corresponding to 37 or 39. Further, while 3 output circuits (for providing $I_4$, $I_5$, $I_6$) are illustrated, more or fewer than this number can be employed.

If single transistor current mirrors are used in place of the cascoded pairs of the mirrored supply 36, the output currents provided will not be as accurately mirrored or as constant in magnitude with value changed in $V_{DD}$. Cascoding is used to obtain better regulation of the individual outputs currents $I_4$, $I_5$, and $I_6$. By cascoding, the gain in regulation is proportional to the gain of each cascoded transistor. Also, in the output stages of the mirror, cascoding raises the output impedance, resulting in an improvement in the range of impedances that can be effectively supplied current. The number of transistors that can be cascoded in any string, i.e. the diode connected FET's 37 and 39, for example, is limited by the voltage $V_{DD}$ that must be supplied to provide one voltage threshold per transistor (must have greater voltage than the total thresholds to be supplied). In the output stages of the current mirror, for each stage of cascoding, a sufficient supply voltage $V_{DD}$ must be provided to maintain the cascoded transistors in saturation. If a greater dynamic operating range than $V_{DD}$ can support is required, output terminals 47, 59, and 63 can be returned to a potential greater than $V_{DD}$. Three levels of cascoding have been found to be a practical limit in the present state of technology.

In the various embodiments of the invention illustrated and discussed, the transistors are shown as field-effect transistors. In general, bipolar transistors can be used instead to provide higher current gain, and enhanced operation of current supply 35. Also, the conductivities of the various transistors can be interchanged, along with corresponding changes in supply voltage polarities, to change the direction of current flow (assuming the same convention for current flow is used).

What is claimed is:

1. A current regulator comprising, in combination:

first and second terminals between which an operating voltage may be applied;

an output current path extending between said terminals including, in series in said path, first resistive means of value $R_1$;

current control means in said output current path for permitting a flow of current through said path between said terminals;

a second current path extending between said terminals, said second current path including means responsive to said flow of current through said output current path for starting a flow of current through said second current path;

feedback means coupled to said current control means and responsive to the flow of current in said second current path, for establishing a substantially fixed voltage $V_{T1}$ across said first resistive means to thereby regulate the current through said output current path to a value $I_{OUT} = V_{T1}/R_1$;

means for establishing a substantially fixed voltage $V_{T2}$ across said second resistive means to thereby regulate the current flowing in said second path to a value $I_2 = V_{T2}/R_2$;

a third current path extending between said terminals, said third current path including means responsive to a flow of current through said second current path for starting a flow of current through said third current path; and second feedback circuit means responsive to the flow of current in said third current path for regulating the voltage across said second resistive means to said fixed value $V_{T2}$.

2. A current regulator as set forth in claim 1 wherein said current control means comprises a control transistor having a conduction path and a control electrode for controlling the conductivity of said conduction path, said conduction path being in series with said first resistive means and said feedback means including a connection to said control electrode.

3. A current regulator as set forth in claim 2 wherein said feedback means comprises a first transistor having an input electrode, an output electrode, a conduction path between the two, and a control electrode for controlling the conductivity of said conduction path, said first transistor in response to a voltage substantially equal to said $V_{T1}$ between its control and input electrodes producing current flow of given value through its conduction path, said conduction path being connected in series with said second resistive means in said second current path, said first resistive means being connected between said input and control electrodes, and said output electrode being connected to the control electrode of said control transistor.

4. A current regulator as set forth in claim 3 wherin said first transistor comprises an MOS transistor.

5. A current regulator as set forth in claim 4 wherein said means for establishing a substantially fixed voltage $V_{T2}$ across said second resistive means comprises a second MOS transistor of opposite conductivity type to said first transistor, said second transistor having input, output, and control electrodes and a conduction path between its input and output electrodes, said second resistive means being connected beteen said input and said control electrodes of said second transistor, and same means further including a series path between said terminals including the conduction path of said second transistor for establishing a flow of current through said conduction path of said second transistor for producing a feedback voltage to stabilize the flow of current in said second current path to said value $I_2$, whereby said voltage $V_{T2}$ is produced across said second resistive means.

6. A current regulator as set forth in claim 3 further including, in said second current path, a second control transistor, said second control transistor including a conduction path in series with said second resistive means and a control electrode for controlling the conduction through said conduction path of said second control transistor; and a third current path extending between said terminals, said third current path including means responsive to a flow of current in said second current path for starting a flow of current in said third current path, and second feedback circuit means connected to said control electrode of said second control transistor, responsive to the flow of current in said third current path for establishing said voltage $V_{T2}$ across said second resistive means.

7. A current regulator as set forth in claim 6 wherein said second feedback means includes a transistor in said third current path having input, output, and control electrodes, and a conduction path between said input and output electrodes, said second resistive means being connected between said input and said control electrodes, said conduction path being connected in series in said third current path, and said output electrode of said transistor in said third current path being connected to the control electrode of said second control transistor.

8. A current regulator as set forth in claim 1 wherein said feedback means comprises a first transistor having an input electrode, an output electrode, a conduction path between the two, and a control electrode for controlling the conductivity of said conduction path, said transistor, in response to a voltage substantially equal to said $V_{T1}$ between its control and input electrodes producing a current flow of a given value through its conduction path, said conduction path being connected in series with said second resistive means in said second current path, said first resistive means being connected between said input and control electrodes.

9. A current regulator as set forth in claim 1, further including a current mirror amplifier having an input current path and at least one output current path, said input current path being in series with the output current path of said current regulator, and said output current path of said current mirror amplifier being coupled between said two terminals.

10. A master constant current supply comprising the combination of:

first and second resistors;

a voltage rail;

a point of reference potential;

a first pair of output terminals;

first, second, and third transistors of one conductivity type, and fourth and fifth transistors of opposite conductivity type, each of said transistors having source, drain, and gate electrodes, the source electrodes of said first and second transistors being connected to said voltage rail, the gate and drain electrodes of said first transistor being connected in common to the drain and gate electrodes of said fourth and fifth transistors, respectively, the drain electrodes of said second and fifth transistors being connected in common to the gate electrode of said third transistor; the gate electrode of said second transistor being connected to the source electrode of said third transistor and coupled to said voltage rail via said first resistor; one of said pair of output terminals being connected to the drain electrode of said third transistor, the other being connected to said point of reference potential; the gate and source electrodes of said fourth and fifth transistors, respectively, being connected in common and coupled via said second resistor to said point of reference potential; and the source electrode of said fourth transistor being connected to said point of reference potential.

11. The combination of claim 10, which further includes:

means connected between said pair of output terminals for providing at least one secondary constant current supply controlled by said master supply.

12. The combination of claim 11, wherein said means for providing at least one secondary constant current supply includes:

a second pair of output terminals, one of which is connected to said voltage rail; and a transistorized current mirror of like conductivity to said fourth and fifth transistors having an input and a common terminal connected across said one and other first pair of output terminals, respectively, and an output terminal being the other one of said second pair of output terminals.

13. A current supply comprising, in combination:

first and second terminals between which an operating voltage may be applied;

first and second transistors of one conductivity type and a third transistor of opposite conductivity type, each having a conduction path and a control electrode;

first and second resistors;

two terminals for a load, one connected to said second terminal;

a first series circuit connected between said first terminal and the other terminal for said load, comprising said first resistor and the conduction path of said first transistor, in that order;

a second series circuit connected between said first and second terminals comprising the conduction path of said second transistor, the conduction path of said third transistor and said second resistor, in that order;

a direct connection from the control electrode of said second transistor to the connection between the conduction path of said first transistor and said first resistor;

a direct connection from the control electrode of the first transistor to the connection between the conduction paths of the second and third transistors; and means coupled to the control electrode of said third transistor for applying a voltage thereto for regulating the flow of current through its conduction path.

14. A current supply as set forth in claim 13, wherein said means coupled to the control electrode of said third transistor comprises:

means responsive to current flow through said second series circuit for supplying a voltage to the control electrode of said third transistor for establishing a fixed voltage across said second transistor.

15. A current supply as set forth in claim 14, wherein said means responsive to current flow comprises:

a fourth transistor of the same conductivity type as said third transistor, said fourth transistor having an input electrode connected to said second terminal, an output electrode directly connected to said control electrode of said third transistor, and a control electrode directly connected to the connection between said second resistor and the conduction path of said third transistor, and means coupled between said first terminal and said output electrode of said fourth transistor for supplying an operating voltage thereto.

16. A current supply as set forth in claim 15, wherein said means coupled between said first terminal and said output electrode comprises a diode connected fifth transistor.

17. A current supply as set forth in claim 13, wherein all of said transistors are field effect transistors of the enhancement type.

* * * * *